US012604953B1

(12) United States Patent
Feng

(10) Patent No.: US 12,604,953 B1
(45) Date of Patent: Apr. 21, 2026

(54) MULTIFUNCTIONAL SUITCASE

(71) Applicant: Jiaxing Packdrop Luggage Technology Co., Ltd., Jiaxing (CN)

(72) Inventor: Tan Feng, Jiaxing (CN)

(73) Assignee: Jiaxing Packdrop Luggage Technology Co., Ltd., Jiaxing (CN)

( * ) Notice: Subject to any disclaimer, the term of this patent is extended or adjusted under 35 U.S.C. 154(b) by 0 days.

(21) Appl. No.: 19/239,844

(22) Filed: Jun. 16, 2025

(30) Foreign Application Priority Data

Apr. 22, 2025 (CN) ..... 202520765219.4

(51) Int. Cl.
*A45C 5/03* (2006.01)
*A45C 9/00* (2006.01)
*A45C 13/26* (2006.01)

(52) U.S. Cl.
CPC ..... *A45C 5/03* (2013.01); *A45C 9/00* (2013.01); *A45C 2009/002* (2013.01); *A45C 2013/267* (2013.01)

(58) Field of Classification Search
CPC ..... A45C 5/03; A45C 9/00; A45C 2009/002; A45C 2013/267
See application file for complete search history.

(56) References Cited

U.S. PATENT DOCUMENTS

| | | | | |
|---|---|---|---|---|
| D372,843 | S * | 8/1996 | Trent | D6/336 |
| 5,547,053 | A * | 8/1996 | Liang | A45C 13/262 16/113.1 |
| 7,097,181 | B2 * | 8/2006 | Sadow | A45C 13/262 280/37 |
| 10,827,813 | B2 * | 11/2020 | Abrahamyan-Smith | A45C 9/00 |
| D952,340 | S * | 5/2022 | Lacerda Braga | D3/293 |
| 2017/0096264 | A1 * | 4/2017 | Anderson | B65D 43/163 |
| 2024/0324741 | A1 * | 10/2024 | Feng | A45C 13/262 |

FOREIGN PATENT DOCUMENTS

KR 20150140965 A * 12/2015 ..... A45C 13/385

* cited by examiner

*Primary Examiner* — Tri M Mai
(74) *Attorney, Agent, or Firm* — Hemisphere Law, PLLC

(57) ABSTRACT

A multifunctional suitcase is provided, including a case body, a case top cover, a telescopic pull rod and a movable flap. The case body includes a top surface, a front side surface and a rear side surface. The case top cover is connected to the top surface through a connecting structure and covers at least a side of the top surface facing toward the front side surface. The telescopic pull rod is disposed on the rear side surface and is extendable or retractable relative to the top surface. The movable flap is rotatably connected to a front end of the case top cover, and is rotatable to be buckled or opened relative to the case top cover to define an accommodation space. The case top cover enhances a bearing capacity of the top surface and the movable flap can prevent articles from falling.

5 Claims, 5 Drawing Sheets

MULTIFUNCTIONAL SUITCASE

CROSS-REFERENCE TO RELATED APPLICATION

This application claims priority to Chinese Patent Application No. 202520765219.4, filed Apr. 22, 2025, which is herein incorporated by reference in its entirety.

TECHNICAL FIELD

The disclosure relates to the technical field of suitcases, and more particularly to a multifunctional suitcase.

BACKGROUND

When people are queuing or waiting for vehicles and have no seats to sit, they will choose to sit on their suitcases. Since a top of a suitcase is relatively soft and lacks support, sitting on the suitcase may be unstable and may even cause the suitcase to collapse or deform. In addition, articles such as umbrellas, drinks, snacks that people use temporarily during a journey, or various large and small bags bought during the journey are prone to falling when placed on the top of the suitcase. When holding a handle of a telescopic rod of the suitcase with one hand, people also have to clutch handles of multiple bags. Once release their hands, the small bags will scatter all over a place. It becomes even more chaotic and inconvenient for people to go through security checks.

SUMMARY

The disclosure aims to provide a multifunctional suitcase to solve a technical problem that top surfaces of suitcases in the related art are too soft, causing cases are easily damaged when people sit on them, and articles placed on the top surfaces are prone to falling.

In one aspect of the disclosure, a multifunctional suitcase is provided. The multifunctional suitcase includes a case body, a case top cover, a telescopic pull rod and a movable flap (also referred to as a movable flipping plate), and the case body includes a top surface, a front side surface and a rear side surface;

- the case top cover is connected to the top surface and covers at least a side of the top surface facing toward the front side surface;
- the telescopic pull rod is disposed on the rear side surface and is extendable or retractable relative to the top surface; and
- the movable flap is rotatably connected to a front end of the case top cover, and the movable flap is rotatable to be buckled relative to the case top cover or opened relative to the case top cover to define an accommodation space.

In an embodiment, the top surface is provided with a recessed part, and the case top cover is disposed inside the recessed part.

In an embodiment, the multifunctional suitcase further includes a torsion spring, and the torsion spring is disposed at a rotational connection position between the movable flap and the case top cover.

In an embodiment, an upper end of the movable flap is provided with an outer flanging, and the outer flanging is disposed at a side of the movable flap facing away from the telescopic pull rod.

In an embodiment, a handle is disposed on the case top cover, and a hollowed hole is defined on the movable flap.

The handle is disposed corresponding to the hollowed hole and exposed through the hollowed hole.

In an embodiment, the movable flap is provided with a left barrier plate on a left end of the movable flap and a right barrier plate on a right end of the movable flap, and the case body further includes a left side surface and a right side surface;

- when the movable flap is rotated to be buckled relative to the case top cover, the left barrier plate is disposed at the left side surface, and the right barrier plate is disposed at the right side surface; and
- when the movable flap is rotated to be opened relative to the case top cover, the movable flap, the left barrier plate and the right barrier plate together define the accommodation space.

In an embodiment, the multifunctional suitcase further includes a pair of connecting reinforcement pieces (i.e., connecting pieces), and the left barrier plate is connected to the left side surface through one of the pair of connecting reinforcement pieces, and the right barrier plate is connected to and the right side surface through another one of the pair of connecting reinforcement pieces.

In an embodiment, the movable flap includes a connecting part and a backrest part, a lower end of the connecting part is rotatably connected to the front end of the case top cover, and the backrest part is rotatably connected to an upper end of the connecting part.

Compared to technologies in the related art, the multifunctional suitcase provided by the disclosure has following beneficial effects.

The multifunctional suitcase provided by the disclosure includes the case body, the case top cover, the telescopic pull rod and the movable flap. The case body includes the top surface, the front side surface and the rear side surface. The case top cover is connected to the top surface and covers at least the side of the top surface facing toward the front side surface. The telescopic pull rod is disposed on the rear side surface and is capable of being extended or retracted relative to the top surface. The movable flap is rotatably connected to the front end of the case top cover, and can be rotated to be buckled relative to the case top cover or opened relative to the case top cover to define the accommodation space.

The case top cover is disposed on the top surface of the case body. The case top cover enhances a bearing capacity of the top surface, making the multifunctional suitcase convenient for people to sit on and less prone to deformation, and people do not need to worry about the case body being damaged. The movable flap is rotatably disposed on the case top cover. When the movable flap is rotated to be buckled relative to the case top cover, the movable flap can further enhance the bearing capacity of the top surface. When the movable flap is rotated to be opened relative to the case top cover to define the accommodation space, it's convenient for people to place small handbags, umbrellas, snack bottles or other bags in the accommodation space at any time. The movable flap can prevent articles from falling, allowing people to free their hands to handle other tasks during a journey, such as answering calls, checking in at station or shopping. Moreover, since the movable flap is disposed on a top of the case body, it doesn't occupy an internal accommodation space of the case body, nor does it increase a volume of the case body, and it doesn't affect appearance, storage, boarding or consignment of the multifunctional suitcase.

Other features and beneficial effects of the disclosure will be described in detail in following section of detailed description of embodiments.

BRIEF DESCRIPTION OF DRAWINGS

To more clearly describe specific embodiments of the disclosure or technical solutions in the related art, attached drawings needed in description of the specific embodiments or the technical solutions in the related art will be briefly introduced below. Apparently, the attached drawings in following description are merely a part of the embodiments of the disclosure, so that those skilled in the art can obtain other attached drawings based on the attached drawings without creative labors.

Figure 1:
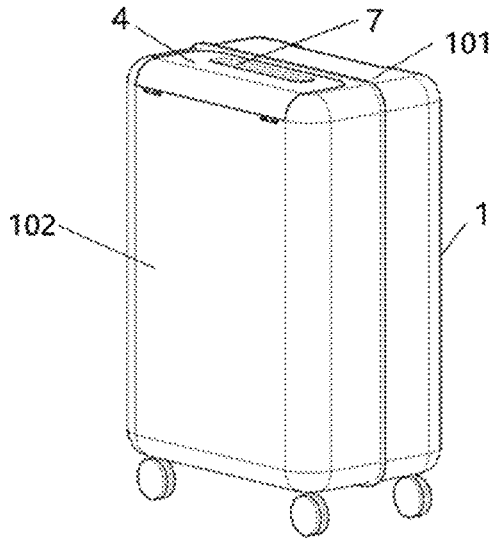
FIG. 1 illustrates a schematic structural diagram of a movable flap of a multifunctional suitcase being buckled according to an embodiment of the disclosure.

Parts that are identical or structurally and functionally equivalent across different embodiments are assigned the same reference character. Reference characters with primes (e.g., 2', 2") denote modified or alternative configurations of a part in a respective embodiment, and are used only where structural differences exist.

Description of reference characters: 1: case body; 101: top surface; 102: front side surface; 103: rear side surface; 104: left side surface; 105: right side surface; 2, 2', 2": case top cover; 3, 3', 3": telescopic pull rod; 4, 4', 4": movable flap; 401: outer flanging; 5, 5', 5": recessed part; 6: handle; 7, 7': hollowed hole; 8: left barrier plate; 9: right barrier plate; 10: connecting part; 11: backrest part; 12: connecting piece; 13: long hole; 14: torsion spring.

DETAILED DESCRIPTION OF EMBODIMENTS

Technical solutions of the disclosure will be clearly and completely described with reference to embodiments. Apparently, the embodiments described are merely part of embodiments of the disclosure, not all of them. Based on the embodiments of the disclosure, all other embodiments obtain by those skilled in the art without creative labors fall within a scope of protection of the disclosure.

It should be noted that, in the description of the disclosure, orientations or positional relationships indicated by terms "center", "upper", "lower", "left", "right", "vertical", "horizontal", "inner", "outer", are based on the orientations or positional relationships illustrated in attached drawings. These terms are intended only to facilitate the description of the disclosure and to simplify the description, and are not intended to indicate or imply that the device or components referred to must have a specific orientation, be constructed and operated in a specific orientation. Therefore, these terms should not be construed as limitations to the disclosure. In addition, terms such as "first", "second", and "third" are only used for descriptions and should not be understood as indicating or implying relative importance.

In the description of the disclosure, it should further be noted that, unless otherwise clearly specified and limited, the terms "dispose", "connect" and "link" should be understood in a broad sense. For example, it can be a fixed connection, a detachable connection, or an integral connection, it can be a mechanical connection, or an electrical connection, and it can be a direct connection, an indirect connection through an intermediate medium, or an internal connection between two components. For those skilled in the art, the specific meanings of the above terms in the disclosure can be understood according to specific situations.

In addition, technical solutions of each embodiment can be combined with each other, but this must be on a basis that can be achieved by those skilled in the art. When a combination of technical solutions is contradictory or unfeasible, it should be considered that such the combination of technical solutions does not exist and does not fall within the scope of protection of the disclosure.

The disclosure will be further described in detail with reference to specific embodiments and attached drawings.

Specific structures are illustrated in FIG. 1 through FIG. 10.

An embodiment of the disclosure provides a multifunctional suitcase. The multifunctional suitcase includes a case body 1, a case top cover (e.g., 2, 2', or 2"), a telescopic pull rod (e.g., 3, 3', 3") and a movable flap (e.g., 4, 4', 4"). The case body 1 includes a top surface 101, a front side surface 102 and a rear side surface 103. The case top cover (e.g., 2, 2', or 2") is connected to the top surface 101 and covers at least a side of the top surface 101 facing toward the front side surface 102. The telescopic pull rod (e.g., 3, 3', 3") is disposed on the rear side surface 103 and is extendable or retractable relative to the top surface 101. The movable flap (e.g., 4, 4', 4") is rotatably connected to a front end of the case top cover (e.g., 2, 2', or 2"). The movable flap (e.g., 4, 4', 4") is rotatable to be buckled relative to the case top cover (e.g., 2, 2', or 2") or opened relative to the case top cover (e.g., 2, 2', or 2") to define an accommodation space.

Figure 2:
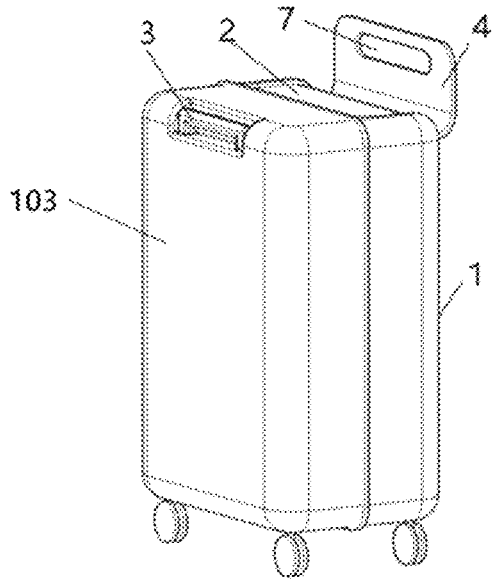
FIG. 2 illustrates a schematic structural diagram of the movable flap of the multifunctional suitcase illustrated in FIG. 1 being opened.
Figure 3:
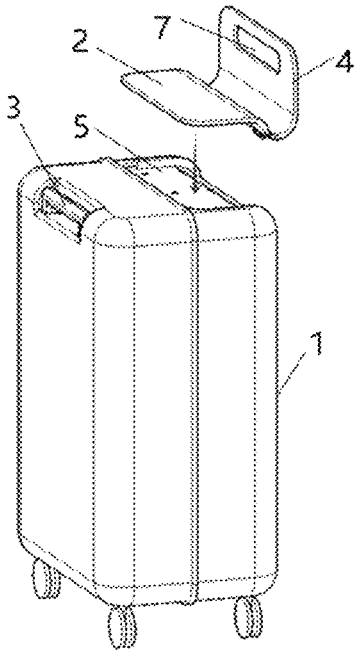
FIG. 3 illustrates a schematic installation diagram of a case top cover of the multifunctional suitcase illustrated in FIG. 1.

Specifically, reference characters 2, 3, and 4 refer to the case top cover, the telescopic pull rod, and the movable flap of the multifunctional suitcase illustrated in FIG. 1 through FIG. 3, respectively. Reference characters 2', 3', and 4' refer to the case top cover, the telescopic pull rod, and the movable flap of the multifunctional suitcase illustrated in FIG. 4 and FIG. 6 and the multifunctional suitcase illustrated in FIG. 5, respectively. Reference characters 2", 3", and 4" refer to the case top cover, the telescopic pull rod, and the movable flap of the multifunctional suitcase illustrated in FIG. 7 through FIG. 9, respectively.

In the embodiment, the case top cover (e.g., 2, 2', or 2") is disposed on the top surface 101 of the case body 1. The case top cover (e.g., 2, 2', or 2") enhances a bearing capacity of the top surface 101, making a suitcase (i.e., the multifunctional suitcase) convenient for people to sit on and less prone to deformation, and people do not need to worry about the case body 1 being damaged. The movable flap (e.g., 4, 4', 4") is rotatably disposed on the case top cover (e.g., 2, 2', or 2"). When the movable flap (e.g., 4, 4', 4") is rotated to be buckled relative to the case top cover (e.g., 2, 2', or 2"), the movable flap (e.g., 4, 4', 4") can further enhance the bearing capacity of the top surface 101. When the movable flap (e.g., 4, 4', 4") is rotated to be opened relative to the case top cover (e.g., 2, 2', or 2") to define the accommodation space, it's convenient for people to place small handbags, umbrellas, snack bottles or other bags in the accommodation space at any time. The movable flap (e.g., 4, 4', 4") can prevent articles from falling, allowing people to free their hands to handle other tasks during a journey, such as answering calls, checking in at station or shopping. Moreover, since the movable flap (e.g., 4, 4', 4") is disposed on a top of the case body 1, it doesn't occupy an internal accommodation space of the case body 1, nor does it increase a volume of the case body 1, and it doesn't affect appearance, storage, boarding or consignment of the suitcase.

Figure 4:
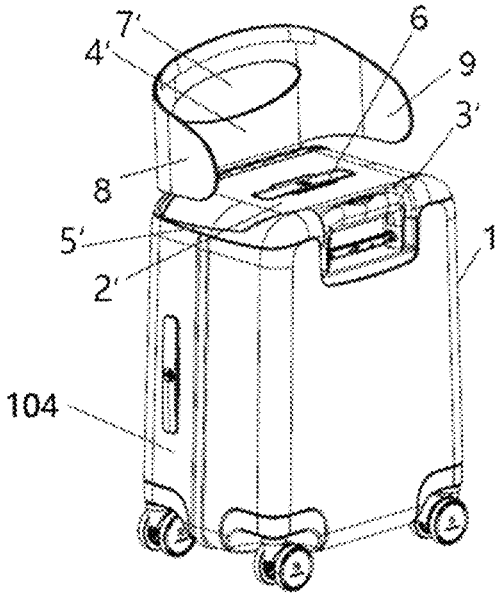
FIG. 4 illustrates a schematic structural diagram of a movable flap of a multifunctional suitcase being opened with a left barrier plate disposed on a left end of the movable flap and a right barrier plate disposed on a right end of the movable flap according to an embodiment of the disclosure.
Figure 5:
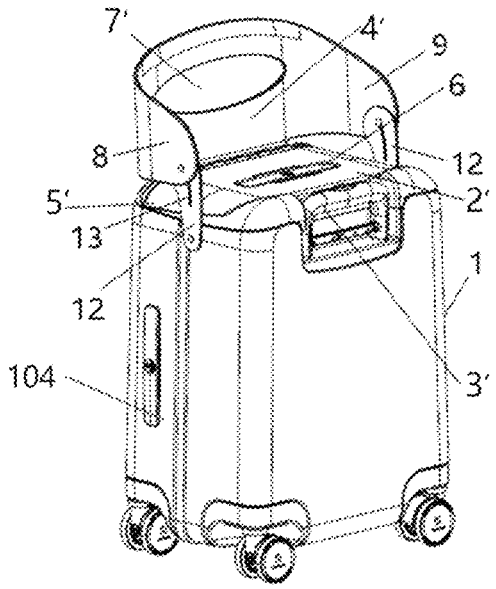
FIG. 5 illustrates a schematic structural diagram of a left barrier plate and a right barrier plate of a movable flap of a multifunctional suitcase being connected to a case body through connecting pieces according to an embodiment of the disclosure.
Figure 7:
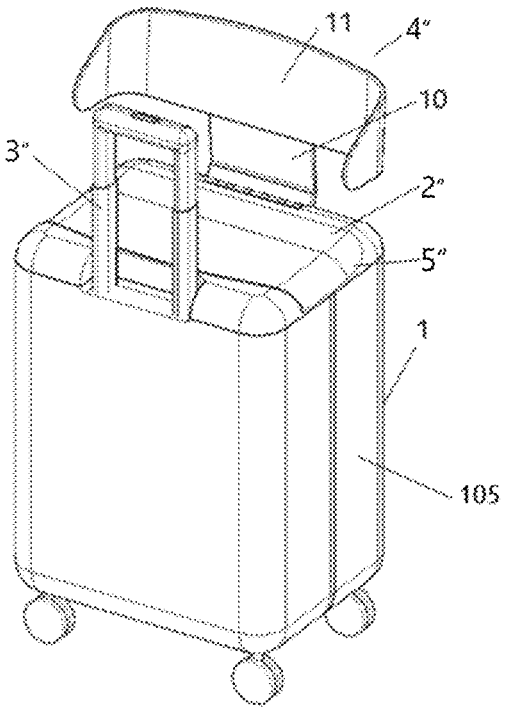
FIG. 7 illustrates a schematic structural diagram of a movable flap of a multifunctional suitcase being opened and including a connecting part and a backrest part according to an embodiment of the disclosure from a side view.

In the embodiment, as illustrated in FIG. 4 and FIG. 5, the case top cover 2' can cover a whole of the top surface 101 of the case body 1, or as illustrated in FIG. 1 and FIG. 7, the case top cover (e.g., 2, 2") can cover a part of the top surface 101 of the case body 1. The case top cover (e.g., 2, 2', or 2") covers at least the side of the top surface 101 facing toward the front side surface 102 to ensure that the front end of the case top cover (e.g., 2, 2', or 2") is disposed at the front side surface 102. In this way, when the movable flap (e.g., 4, 4', 4") is rotated to be opened relative to the case top cover (e.g., 2, 2', or 2") to define the accommodation space, the movable flap (e.g., 4, 4', 4") is disposed at a front side of the top of the case body 1 and the telescopic pull rod (e.g., 3, 3', 3") is disposed at a rear side of the top of the case body 1, so that a distance between the movable flap (e.g., 4, 4', 4") and the telescopic pull rod (e.g., 3, 3', 3") can be maximized to maximize the accommodation space.

In an embodiment, the top surface 101 is provided with a recessed part (e.g., 5, 5', 5"), and the case top cover (e.g., 2, 2', or 2") is disposed inside the recessed part (e.g., 5, 5', 5"). A rotational connection position between the movable flap (e.g., 4, 4', 4") and the case top cover (e.g., 2, 2', or 2") is disposed in the recessed part (e.g., 5, 5', 5"). In this way, when the movable flap (e.g., 4, 4', 4") is rotated to be buckled relative to the case top cover (e.g., 2, 2', or 2"), a surface of the movable flap (e.g., 4, 4', 4") is flush with the case top cover (e.g., 2, 2', or 2") of the suitcase, making the suitcase beautiful as a whole and the movable flap (e.g., 4, 4', 4") not easy to be scratched and interfered by external objects.

Specifically, reference character 5 refers to the recessed part of the multifunctional suitcase illustrated in FIG. 1 through FIG. 3. Reference character 5' refers to the recessed part of the multifunctional suitcase illustrated in FIG. 4 and FIG. 6 and the multifunctional suitcase illustrated in FIG. 5. Reference character 5" refers to the recessed part of the multifunctional suitcase illustrated in FIG. 7 through FIG. 9.

Figure 10:
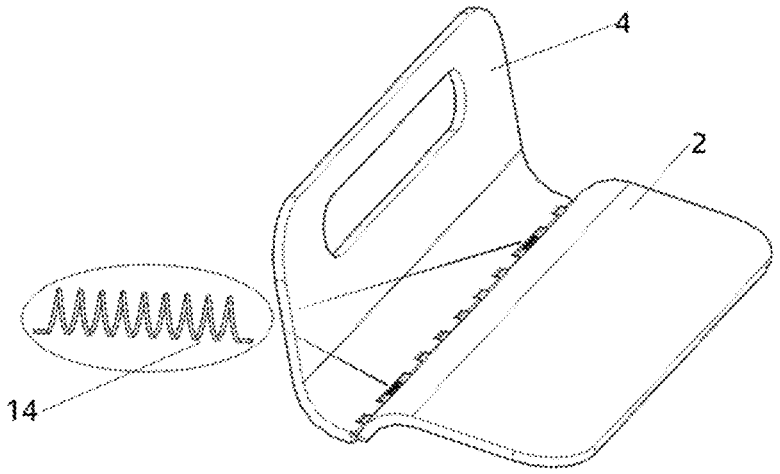
FIG. 10 illustrates a schematic structural diagram of a rotational connection position between the movable flap and the case top cover of the multifunctional suitcase illustrated in FIG. 1.

In an embodiment, as illustrated in FIG. 10, the multifunctional suitcase further includes a torsion spring 14. The torsion spring 14 is disposed at the rotational connection position between the movable flap 4 and the case top cover 2.

In the embodiment, the movable flap 4 is rotatably connected to the case top cover 2 through a hinge. A first hinge groove is defined on the movable flap 4. A part of the hinge disposed on the movable flap 4 is disposed in the first hinge groove. A second hinge groove is defined on the case top cover 2. A part of the hinge disposed on the case top cover 2 is disposed in the second hinge groove. In this way, the structure is simple, and rotation is convenient and stable. The hinge is disposed in the first hinge groove and the second hinge groove to avoid being exposed, therefore making the structure beautiful and avoiding being interfered by the external objects. The torsion spring 14 is disposed on the hinge. A disposition of the torsion spring 14 enables the movable flap 4 to tightly cling to the case top cover 2 in a natural state. The movable flap 4 will not loosen and does not affect the consignment. When the movable flap 4 is opened relative to the case top cover 2 to define the accommodation space, after articles are placed in the accommodating space, the movable flap 4 presses the articles between the case top cover 2 and the movable flap 4 to prevent the articles from falling.

It should be noted that, the movable flap (e.g., 4, 4', 4") and the case top cover (e.g., 2, 2', or 2") can alternatively be connected by a rotating shaft or other structures satisfying overturning of the movable flap (e.g., 4, 4', 4").

Figure 8:
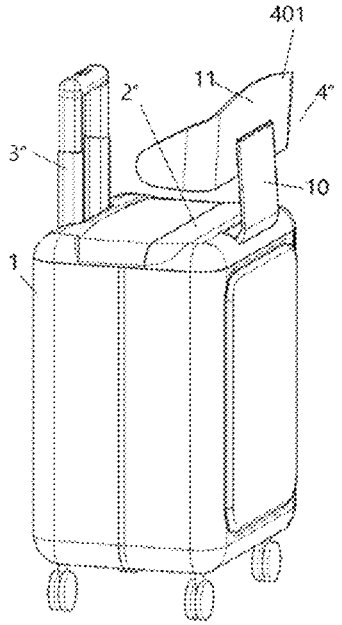
FIG. 8 illustrates a schematic structural diagram of the movable flap of the multifunctional suitcase illustrated in FIG. 7 being opened and including the connecting part and the backrest part from another side view.

In an embodiment, as illustrated in FIG. 8, an upper end of the movable flap 4" is provided with an outer flanging 401. The outer flanging 401 is disposed at a side of the movable flap 4" facing away from the telescopic pull rod 3". In this way, when the movable flap 4" is opened relative to the case top cover 2" and the movable flap 4" is used as a seat backrest, that is, a person sits on the case top cover 2" and leans his or her back on the movable flap 4", a design of the outer flanging 401 conforms to a sitting posture of a human body, so that the back is more comfortable and painless when being leaned on the upper end of the movable flap 4".

Figure 6:
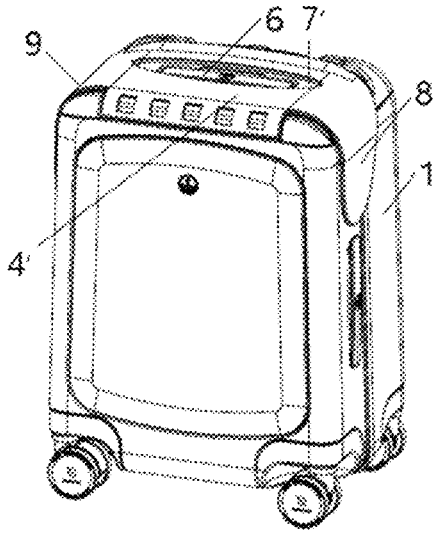
FIG. 6 illustrates a schematic structural diagram of the movable flap of the multifunctional suitcase illustrated in FIG. 4 being buckled with the left barrier plate disposed on the left end of the movable flap and the right barrier plate disposed on the right end of the movable flap.

In an embodiment, as illustrated in FIG. 4 through FIG. 6, a handle 6 is disposed on the case top cover 2'. As illustrated in FIG. 1 through FIG. 6, a hollowed hole (e.g., 7, 7') is defined on the movable flap 4, 4'. The handle 6 is disposed corresponding to the hollowed hole 7' and can be exposed through the hollowed hole 7'.

Specifically, reference character 7 refers to the hollowed hole of the multifunctional suitcase illustrated in FIG. 1 through FIG. 3. Reference character 7' refers to the hollowed hole of the multifunctional suitcase illustrated in FIG. 4 and FIG. 6 and the multifunctional suitcase illustrated in FIG. 5.

In the embodiment, as illustrated in FIG. 4 through FIG. 6, the hollowed hole 7' is defined on the movable flap 4' corresponding to the handle 6 disposed on the case top cover 2'. When the movable flap 4' is rotated to be buckled relative to the case top cover 2', the handle 6 disposed on the case top cover 2' is exposed at the hollowed hole 7', therefore not affecting people using the handle 6.

In an embodiment, as illustrated in FIG. 4 through FIG. 6, the movable flap 4' is provided with a left barrier plate 8 on a left end of the movable flap 4' and a right barrier plate 9 on a right end of movable flap 4'. The case body 1 further includes a left side surface 104 and a right side surface 105. When the movable flap 4' is rotated to be buckled relative to the case top cover 2', the left barrier plate 8 is disposed at the left side surface 104, and the right barrier plate 8 is disposed at the right side surface 105. When the movable flap 4' is rotated to be opened relative to the case top cover 2', the movable flap 4', the left barrier plate 8 and the right barrier plate 9 together define the accommodation space. The movable flap 4', the left barrier plate 8 and the right barrier plate 9 together form a U-shaped enclosure, therefore more effectively preventing the articles on the case top cover 2' from falling.

In an embodiment, as illustrated in FIG. 5, the multifunctional suitcase further includes a pair of connecting reinforcement pieces. The left barrier plate 8 is connected to the left side surface 104 through one of the pair of connecting reinforcement pieces and the right barrier plate 9 is connected to the right side surface 105 through another one of the pair of connecting reinforcement pieces. Connecting the left barrier plate 8 and the right barrier plate 9 to the case body 1 can ensure stability and strength of a whole structure of the suitcase. It should be noted that, the pair of connecting reinforcement pieces have no interference on movement of the left barrier plate 8 and the right barrier plate 9.

In the embodiment, as illustrated in FIG. 5, the pair of connecting reinforcement pieces is a pair of connecting pieces 12. Long holes 13 are defined on the pair of connecting pieces 12. The pair of connecting pieces 12 are respectively rotatably connected to the left side surface 104 and the right side surface 105. The left barrier plate 8 and the right barrier plate 9 are respectively hinged with the long holes 13 on the connecting pieces 12. When the movable flap 4' drives the left barrier plate 8 and the right barrier plate 9 to move, the pair of connecting pieces 12 cooperate with the movement of left barrier plate 8 and the right barrier plate 9 through the long holes 13 while rotating, so as to avoid jamming. The pair of connecting reinforcement pieces can further be made of foldable soft materials, such as two ropes or two pieces of cloth, as long as requirements are met.

Figure 9:
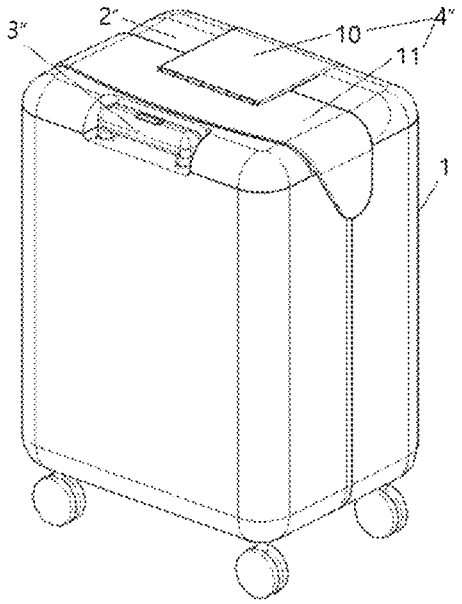
FIG. 9 illustrates a schematic structural diagram of the movable flap of the multifunctional suitcase illustrated in FIG. 7 being buckled and including the connecting part and the backrest part.

In an embodiment, as illustrated in FIG. 7 through FIG. 9, the movable flap 4" includes a connecting part 10 and a backrest part 11. A lower end of the connecting part 10 is rotatably connected to the front end of the case top cover 2". The backrest part 11 is rotatably connected to an upper end of the connecting part 10, so that the backrest 11 can automatically adjust an angle according to a leaning state of the human body to conform to the sitting posture and ergonomics of the human body. The backrest 11 can rotate to fit a waist of the human body and fully support the waist of the human body, so as to relieve waist fatigue during the journey. It should be noted that, a rotational connection between the connecting part 10 and the case top cover 2" has a rotation limit, and a rotational connection between the backrest part 11 and the connecting part 10 has a rotation limit.

In the embodiment, a shape of the backrest part 11 can be a U-shape or a flat, as long as requirements are met.

Finally, it should be noted that, the aforementioned embodiments are merely used to describe the technical solutions of the disclosure, not to limit the disclosure. Although the disclosure has been described in detail with reference to the aforementioned embodiments, those skilled in the art should understand that: they can make modifications to the technical solutions recorded in the aforementioned embodiments or make equivalent replacements to some or all of the technical features therein. Those modifications and equivalent replacements do not make essence of corresponding technical solutions deviate from a scope of the technical solutions of each embodiment of the disclosure.

What is claimed is:

1. A multifunctional suitcase, comprising a case body (1), a case top cover (2'), a telescopic pull rod (3') and a movable flap (4'), wherein the case body (1) comprises a top surface (101), a front side surface (102) and a rear side surface (103);

wherein the case top cover (2') is connected to the top surface (101) and covers at least a side of the top surface (101) facing toward the front side surface (102);

wherein the telescopic pull rod (3') is disposed on the rear side surface (103) and is extendable or retractable relative to the top surface (101);

wherein the movable flap (4') is rotatably connected to a front end of the case top cover (2'), and the movable flap (4') is rotatable to be buckled relative to the case top cover (2') or opened relative to the case top cover (2') to define an accommodation space;

wherein the movable flap (4') is provided with a left barrier plate (8) on a left end of the movable flap (4') and a right barrier plate (9) on a right end of the movable flap (4'), and the case body (1) further comprises a left side surface (104) and a right side surface (105);

wherein when the movable flap (4') is rotated to be buckled relative to the case top cover (2'), the left barrier plate (8) is disposed at the left side surface (104), and the right barrier plate (8) is disposed at the right side surface (105); and wherein when the movable flap (4') is rotated to be opened relative to the case top cover (2'), the movable flap (4'), the left barrier plate (8) and the right barrier plate (9) together define the accommodation space.

2. The multifunctional suitcase as claimed in claim 1, wherein the top surface (101) is provided with a recessed part (5'), and the case top cover (2') is disposed inside the recessed part (5').

3. The multifunctional suitcase as claimed in claim 1, wherein a handle (6) is disposed on the case top cover (2'), a hollowed hole (7') is defined on the movable flap (4'), and the handle (6) is disposed corresponding to the hollowed hole (7') and exposed through the hollowed hole (7').

4. The multifunctional suitcase as claimed in claim 1, further comprising: a pair of connecting reinforcement pieces, wherein the left barrier plate (8) is connected to the left side surface (104) through one of the pair of connecting reinforcement pieces, and the right barrier plate (9) is connected to the right side surface (105) through another one of the pair of connecting reinforcement pieces.

5. A multifunctional suitcase, comprising a case body (1), a case top cover (2'), a telescopic pull rod (3') and a movable flap (4'), wherein the case body (1) comprises a top surface (101), a front side surface (102) and a rear side surface (103);

wherein the case top cover (2') is a part of the top surface (101);

wherein the telescopic pull rod (3') is disposed on the rear side surface (103) and is extendable or retractable relative to the top surface (101);

wherein the movable flap (4') is rotatably connected to a front end of the case top cover (2'), and the movable flap (4') is rotatable to be buckled relative to the case top cover (2') or opened relative to the case top cover (2') to define an accommodation space;

wherein the movable flap (4') is provided with a left barrier plate (8) on a left end of the movable flap (4') and a right barrier plate (9) on a right end of the movable flap (4'), and the case body (1) further comprises a left side surface (104) and a right side surface (105);

wherein when the movable flap (4') is rotated to be buckled relative to the case top cover (2'), the left barrier plate (8) is disposed at the left side surface (104), and the right barrier plate (8) is disposed at the right side surface (105); and wherein when the movable flap (4') is rotated to be opened relative to the case top cover (2'), the movable flap (4'), the left barrier plate (8) and the right barrier plate (9) together define the accommodation space.

* * * * *